United States Patent [19]

Shibano et al.

[11] 4,123,758

[45] Oct. 31, 1978

[54] DISC ANTENNA

[75] Inventors: Yoshizo Shibano, Osaka; Tamao Saito; Toshiaki Saikawa, both of Nishinomiya, all of Japan

[73] Assignee: Sumitomo Electric Industries, Ltd., Osaka, Japan

[21] Appl. No.: 772,588

[22] Filed: Feb. 28, 1977

[30] Foreign Application Priority Data

Mar. 4, 1976 [JP] Japan ..... 51-23968
Feb. 27, 1976 [JP] Japan ..... 51-20668

[51] Int. Cl.[2] ..... H01Q 9/16
[52] U.S. Cl. ..... 343/830; 343/845
[58] Field of Search ..... 343/711–713, 343/829, 830, 845, 846, 746

[56] References Cited

U.S. PATENT DOCUMENTS

| | | | |
|---|---|---|---|
| 2,996,713 | 8/1961 | Boyer | 343/850 |
| 3,541,557 | 11/1970 | Miley | 343/746 |
| 3,803,623 | 4/1974 | Charlot, Jr. | 343/846 |
| 3,967,276 | 6/1976 | Goubau | 343/830 |

*Primary Examiner*—Alfred E. Smith
*Assistant Examiner*—David K. Moore
*Attorney, Agent, or Firm*—Carothers and Carothers

[57] ABSTRACT

A disc antenna which consists of a conductor ground plate and a conductor disc provided in parallel to it, signals of a desired frequency being fed between one point on the conductor disc and the point opposite to it on the conductor ground plate and a point on said conductor disc other than said feeding point on the conductor disc being grounded, so as to radiate non-directional electric waves from the space between said conductor disc and conductor ground plate.

5 Claims, 21 Drawing Figures

(a)

(b) A-A'

(a)

(b)

(c)

(d)

(a)

(b)

DISC ANTENNA

BACKGROUND OF THE INVENTION

1. Field of the Invention

The present invention relates to a disc antenna which consists of a conductor disc and a conductor ground plate placed in parallel to each other and which radiates non-directional electric waves from the space between them.

2. Description of the Prior Art

In recent times very remarkable developments have been made with respect to underground streets and towns. As to radio communication systems required for fire-fighting activities, police activities and others in such confined places, a system has been employed in which leaky coaxial cables are laid in the underground streets. However, that system has shortcomings in that it is very expensive to construct a close network of long and large cables in the underground street and also in that it is detrimental to the appearance of the streets.

A system has also been employed in which unipole antennae or the like are installed at fixed intervals in the interior of the underground streets, and these antennae are fed by means of cables connected to their feeding terminals above ground. In the case of this system, however, it involves such problems in that the positions required for the installation of the unipole antennae have to be provided and that, where the underground streets or the like have low ceilings, the antennae may be found a nuisance or may be of a weak construction that is readily damaged.

Furthermore, it has to be noted on the other hand that, although the frequencies in use at the present time for short-distance communication radios concentrate in the 150 MHz band, a change-over to the 400 MHz band in the future is considered possible. It is, under these circumstances, necessary to have antennae common for the two frequency bands of 150 MHz and 400 MHz. The antennae that have been described above will be found unsuitable when a change in frequency is made, or when a multiple frequency service is adopted.

SUMMARY OF THE INVENTION

The present invention provides a non-directional flat antenna particularly suitable for multiple frequency service in underground streets and the like, making improvement over antennae that have such shortcomings as already mentioned.

An object of the present invention is to provide a non-directional disc antenna of a flat stature and strong construction consisting of a conductor ground plate and a conductor disc parallel thereto for the purpose of serving electric waves in a confined place having low ceilings, such as underground streets and the like.

Another object of the present invention is to provide a multi-stage disc antenna which radiates non-directional electric waves of a plurality of frequencies simultaneously or selectively.

Still another object of the present invention is to provide a disc antenna which radiates non-directional electric waves of a plurality of frequencies simultaneously or selectively.

For the purpose of attaining the aforementioned objects, the disc antenna of the present invention has a characteristic which is as follows. It has a plate pair consisting of a conductor disc and a conductor ground plate positioned substantially in parallel to each other with a suitable distance between them. Signals of a prescribed frequency are fed between one point on the circumference of the conductor disc and the point opposite it on the conductor ground plate. Another point on the conductor disc which is different from said point and the point opposite it on the conductor ground plate are short circuited by means of a grounding plate, and thereby non-directional electric waves are caused to radiate from the space formed between the conductor disc and the conductor ground plate.

It furthermore has a characteristic which is as follows. A conductor disc for a second frequency can be provided above said conductor disc, now used as a conductor ground plate, substantially in parallel to it with a suitable distance between them, and a grounding plate of the conductor disc for the second frequency is provided near the grounding plate of said conductor disc for the first frequency. The coaxial cable feeder may be laid along the grounding plate so as not to interfere with the radiation directivity. The addition of one or more conductor discs or a third or more frequencies in the same way is also possible.

Furthermore, a different construction of a disc antenna for common use for two frequencies according to the present invention has a characteristic which is as follows. A metal disc having a circumference about equal to or shorter than the longer of the wavelengths of the frequencies to be used is provided above a conductor ground plate in parallel to it at a fixed distance. One point on the circumference is connected to the input terminal as a feeding point common for two frequencies, or more frequencies, the point on the circumference opposite it is directly grounded as the common grounding point. The circumference is divided into a plurality of sections beginning with said common grounding point which each have an arc length equal to or shorter than the shorter of the wavelengths of the frequencies to be used. These section points are grounded via reactance circuits as grounding points for the shorter wavelength. The middle points of these sections are connected to the feeding points for the shorter frequency signal sources or to the branches via filter circuits connected to the common feeding point for two frequencies so that feeding of two frequency signals may be done simultaneously or selectively.

It is also possible to radiate more than two frequencies in the same way.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE INVENTION

Now, examples of embodiment of the present invention will be described in detail.

Figure 1:
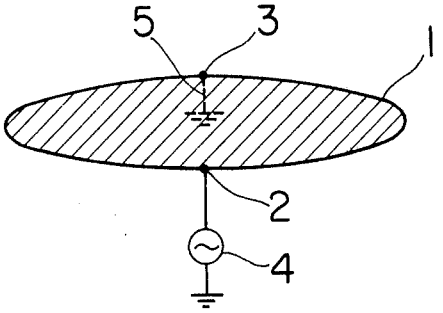
FIGS. 1 and 2 are diagrams explanatory of the basic principle of the present invention.
Figure 2:
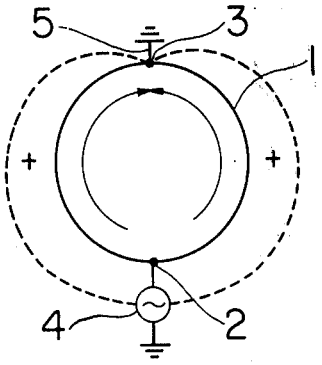

FIGS. 1 and 2 are diagrams explanatory of the basic principle of the present invention. As antenna having a conductor disc 1 placed above a conductor ground plate having infinite expansion substantially in parallel thereto as shown in FIG. 1 is conceived. An electrical signal fed from a signal source 4 connected between the conductor disc 1 at a circumferential point 2 thereof and the conductor ground plate which is spaced from and in parallel with the conductor disc, propagates in the space between the conductor disc and the conductor ground plate and produces a standing wave electric field distribution around the conductor disc 1, while a suitable point 3 on the conductor disc which is different from the feeding point 2 on the conductor disc 1 is grounded by means of a grounding plate 5. The electric field distribution along the circumference of the conductor disc 1 has a finite value at the feeding point 2 and is zero at the grounded point 3, as shown in broken lines in FIG. 2. If in this case the length of the circumference is selected to be one wavelength or less, no inversion of electric field takes place along the standing wave electric field distribution. Consequently, all positions on the circumference become of the same phase, and the radiation directivity by such electric field distributions will not have a null point where the radiation electric field becomes zero in the plane parallel to the grounding plate. Especially if the length of circumference of the disc antenna 1 is selected to be about one-half the wavelength, not only does the radiation directivity become almost non-directional, but also the antenna becomes resonant and improves radiation efficiency.

Figure 3:
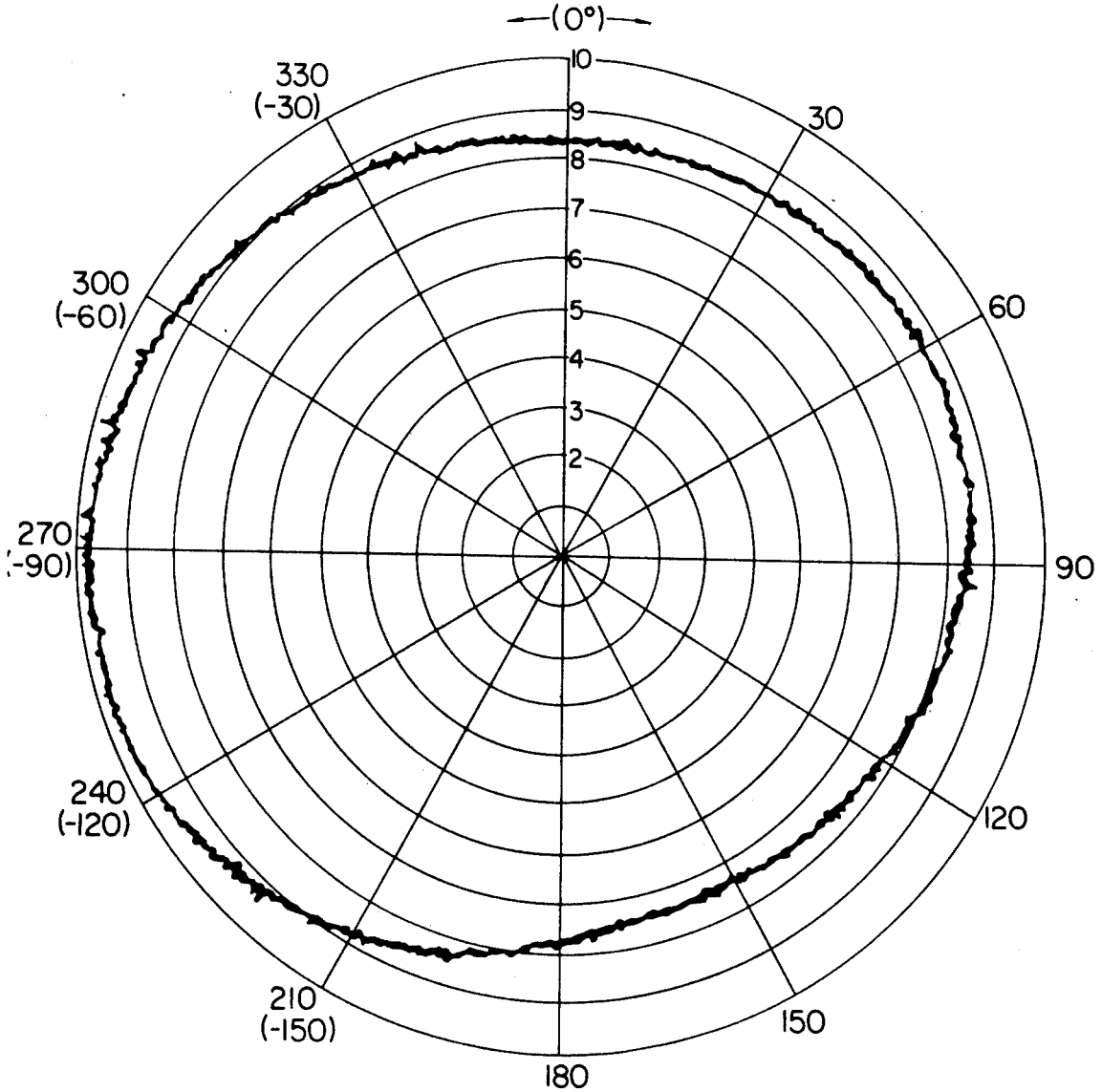
FIG. 3 shows the results of actual measurement of the radiation directivity distribution in a horizontal plane of a disc antenna of circumferential length of one-half the wavelength.

FIG. 3 shows an example of actual measurement results of the radiation directivity of a disc antenna of the present invention in a horizontal plane of the disc antenna having a circumferential length of one-half the wavelength at 150 MHz. The radiation electric field distribution has no null point in the horizontal direction.

In the case of an antenna for actual use, if the circumferential length of the conductor disc is selected to be one-half the wavelength in accordance with the aforementioned basic principle, it will have a comparatively high feeding point impedance. In order to feed it by means of a transmission line such as an ordinary coaxial feeder, impedance matching becomes necessary. For impedance matching of the antenna, a method is frequently employed wherein a transmission line having a suitable characteristic impedance and electric phase angle is inserted between the antenna and the coaxial feeder.

FIGS. 4*a* and 4*b* are diagrams explanatory of an example of construction according to the present invention employing this method. In FIG. 4*a*, the conductor disc 11 and the conductor ground plate 12 are positioned substantially in parallel to each other. The grounding plate 15 is provided between one point on the circumference of the conductor disc 11 and a point opposite it on the conductor ground plate 12, and the feeding plate 14 is provided on another point, different from said point, on the circumference of the conductor disc 11 or on a point opposite it on the conductor ground plate 12. The outer conductor of the coaxial feeder 16 is connected to the grounding plate 15 and the inner conductor 13 is connected to said feeding plate 14 through a hole 17 provided in the grounding plate 15. The Figure shows the feeding plate 14 attached to the conductor ground plate 12, but it may be attached to the conductor disc 11.

In this case, the impedance matching of the coaxial feeder 16 to the antenna is effected, as shown in the A–A' section of FIG. 4*b* by suitably selecting the width *a* of the extension part of the inner conductor 13 and the height *h* from the conductor ground plate.

FIGS. 5*a* and 5*b* show the construction of another example of embodiment of the present invention. FIG. 5*a* shows the part where the coaxial feeder 16 is attached to the grounding plate 15. As shown there, a vertical slit 17 is provided in the grounding plate 15, and the outer conductor of the coaxial feeder 16 is connected to the attaching base 18 while the inner conductor 13 is extended through the slit 17 and is fixed to the feeding plate 14 attached to the grounding plate 12 or 14' attached to the conductor disc 11. By regulating the position of installation of the attaching base 18 and the position of the inner conductor 13 attached to the feeding plate 14 or 14', the height *h* of FIG. 4 can be made variable, and impedance matching possible.

Figure 4:
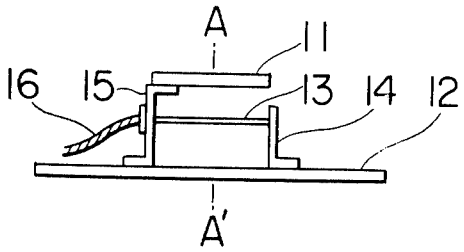
FIGS. 4*a* and 4*b* are diagrams explanatory of the construction of examples of embodiments of the present invention.
Figure 4:
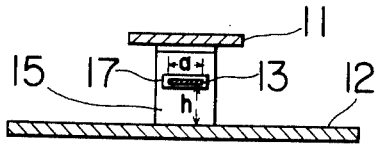
Figure 5:
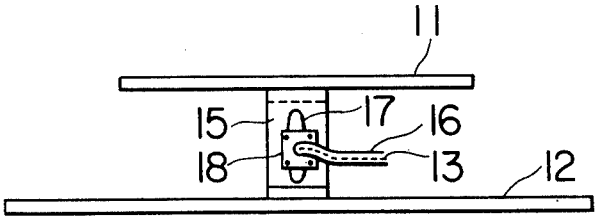
FIGS. 5*a* and 5*b* are diagrams explanatory of the construction of another example of embodiment of the present invention.
Figure 5:
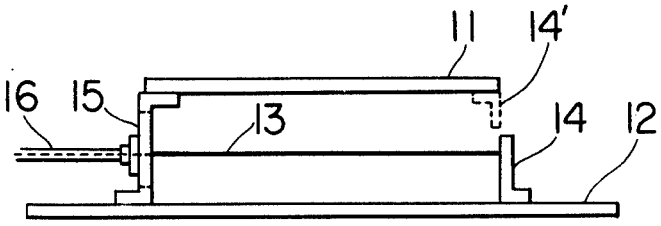

As has been shown with reference to the examples of FIG. 4 and FIG. 5, it is possible to select the characteristic impedance as desired by suitably selecting the dimension and position of the extension of the inner conductor installed between the feeding point of the conductor disc or conductor ground plate and the grounding plate, and thus an impedance matching transformer of said transmission line type can be constituted.

Figure 6:
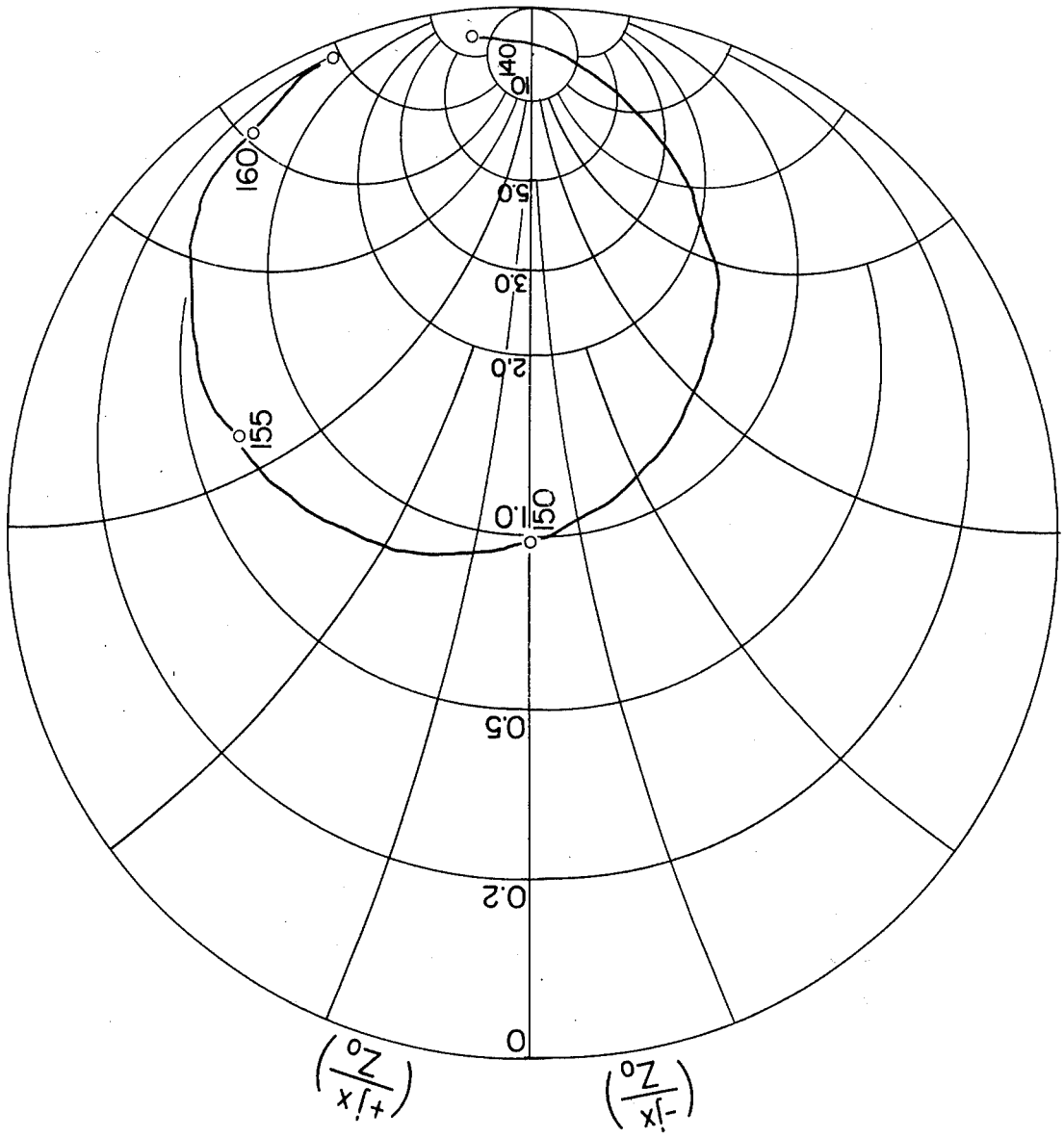
FIGS. 6*a* and 6*b* show the results of actual measurement of disc antennae of circumferential length of one-half the wavelength for 150 MHz and 400 MHz respectively.
Figure 6:
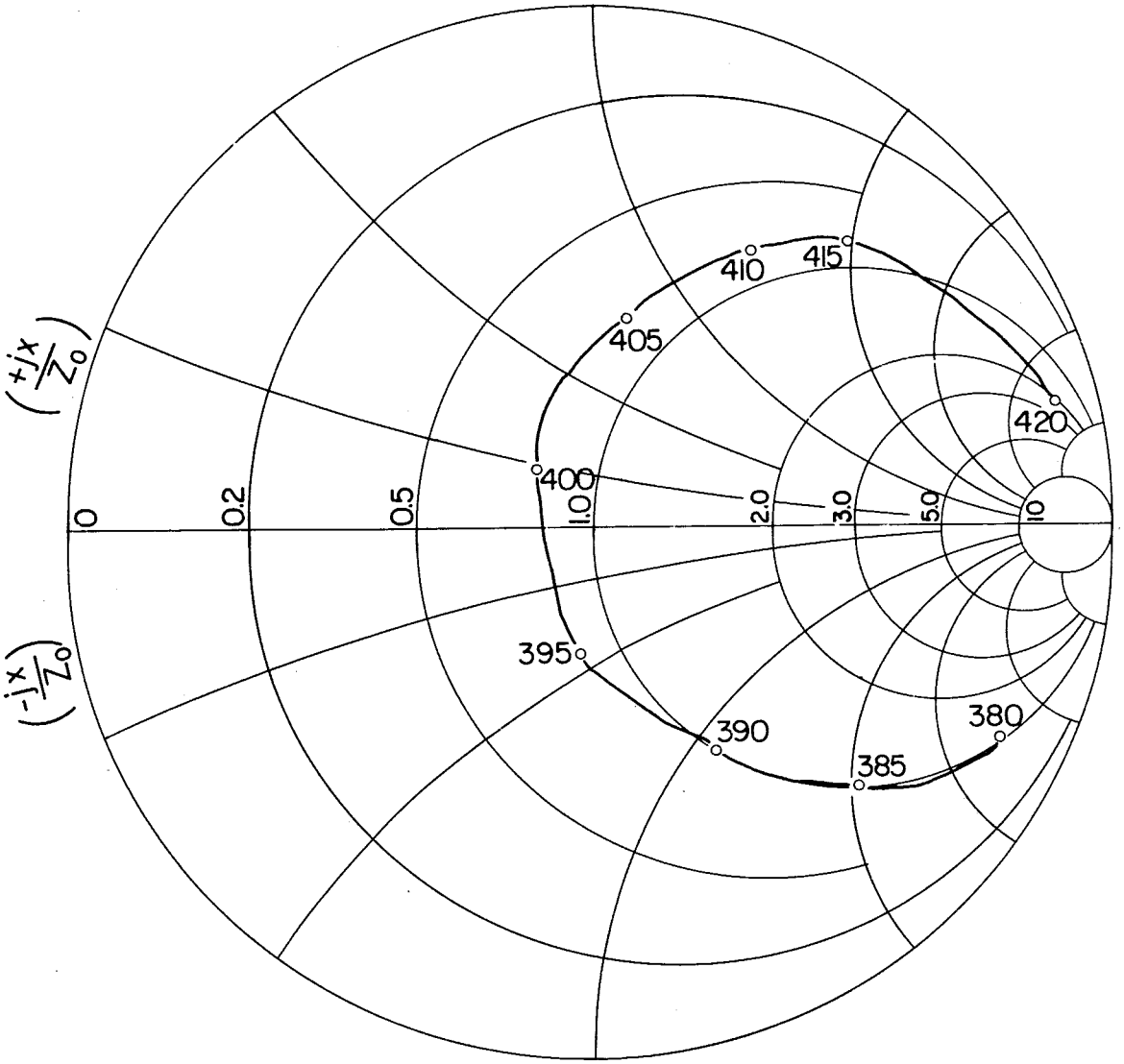

FIGS. 6*a* and 6*b* show the actual measurement values of impedance of disc antennae having a circumferential length of one-half the wavelength at 150 MHz and 400 MHz, respectively. Impedance matching can be done by the use of said extension of the inner conductor corresponding to the required frequency.

Besides, since the coaxial line is connected at the short circuit point where the electric field is zero when this feeding method is employed, there is no disturbance of the electromagnetic field due to the coaxial line and the radiation characteristic is not affected, either. As the extension of the inner conductor between the feeding plate on the conductor disc or conductor ground plate and the grounding plate is fully shielded by the conductor disc, it scarcely affects the electromagnetic field distribution in the circumferential part, and the influence on the radiation characteristic; namely, change in the shape of the radiation pattern, can be ignored.

Furthermore, this feeding system not only merely provides an impedance matching part, but also is used effectively for an antenna for common use for two frequencies, which is to be described later.

Figure 7:
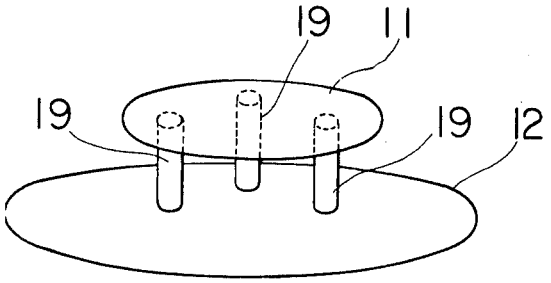
FIG. 7 is a diagram to provide supplementary explanation about an example of embodiment of the present invention.

In the case of a disc antenna for actual use, a disc somewhat larger than the disc plate 11 is, as a matter of fact, good enough for use as the conductor ground plate 12 of the antenna, as shown in FIG. 7, which gives supplementary explanation about parts other than the critical parts, although it is ideal that the grounding plate 12 be an infinite plane. The conductor disc 11 and the conductor ground plate 12 are constructed by assemblying them by means of three poles 19 of an insulating material.

Now the construction of the disc antenna for common use for two frequencies will be explained.

FIGS. 8*a* through 8*d* are explanatory of the construction of a common use antenna for the two frequencies of 150 MHz and 400 MHz.

Figure 8:
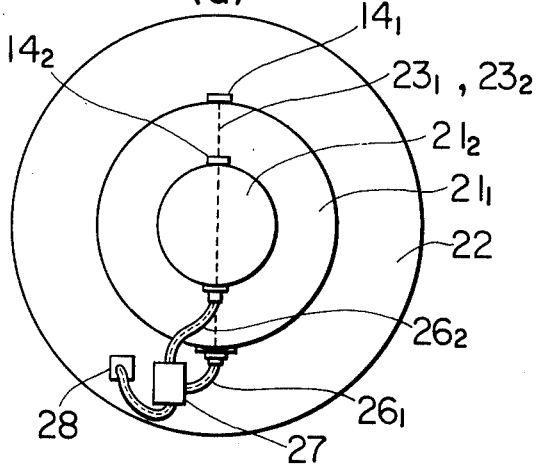
FIGS. 8*a* through 8*d* are diagrams explanatory of the construction of an antenna for joint use for 150 MHz and 400 MHz.
Figure 8:
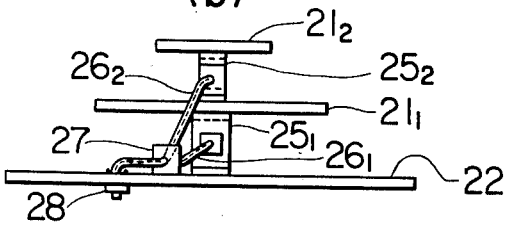
Figure 8:
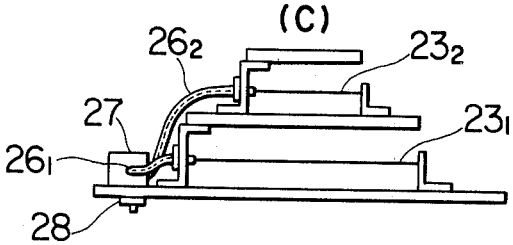
Figure 8:
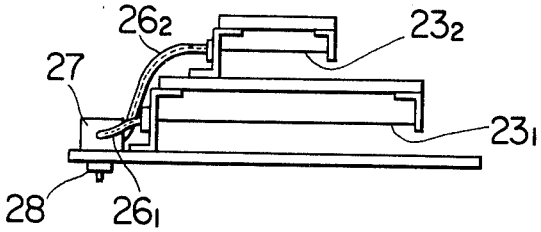

As shown in FIG. 8*a*, a plan figure and FIG. 8*b*, a front view, it consists of a disc antenna which comprises a conductor ground plate 22, a conductor disc $\mathbf{21}_1$ of a circumferential length of one-half the wavelength of 150 MHz waves placed in parallel to the conductor ground plate, and a grounding plate $\mathbf{25}_1$ which short circuits the conductor disc to the conductor ground plate; and a disc antenna which comprises said conductor disc $\mathbf{21}_1$ as its conductor ground plate, a conductor disc $\mathbf{21}_2$ of a circumferential length of one-half the wavelength of 400 MHz waves placed in parallel to the conductor disc $\mathbf{21}_1$ used as its conductor ground plate, and a grounding plate $\mathbf{25}_2$ which short circuits the conductor disc $\mathbf{21}_2$ and the conductor disc $\mathbf{21}_1$, the two antennae being thus stacked together. As shown in FIG. 4 or FIG. 5, the coaxial feeders $\mathbf{26}_1$ and $\mathbf{26}_2$ are respectively attached to the grounding plates $\mathbf{25}_1$ and $\mathbf{25}_2$ of these two disc antennae, the coaxial feeder having been led through the stud 28 and divided into these two branches via the wave separator 27. The outer conductor of the coaxial cable feeder is connected to the grounding plates in this way, and, as shown in FIGS. 8*c* and 8*d*, i.e., side views, the inner conductors $\mathbf{23}_1$ and $\mathbf{23}_2$ are extended in the manner shown in FIG. 5*b* and are fixed to the feeding plates. FIG. 8*c* shows feeding plates attached to the conductor ground plates, while FIG. 8*d* shows feeding plates attached to the conductor discs. The grounding plates of the two disc antennae are installed on the same side near each other in order to make the feeders attached to them as short as possible, and this does not interfere with the radiation electric field, as has already been stated.

As has been described, a disc antenna for 400 MHz is placed on a disc antenna for 150 MHz and the conductor ground plate of the 400 MHz disc antenna is used also as the conductor disc of the 150 MHz disc antenna. The construction of an antenna for common use for two frequencies, which is of a good space factor, is obtained in this way. Furthermore, by locating the grounding points of the 400 MHz disc antenna and 150 MHz disc antenna in the same direction, it is possible to connect the coaxial feeder to the separator at a minimum distance without letting it affect the radiation electric field. It has been made known that this construction enables us to obtain a horizontal plane directivity having no null point in all the directions of a horizontal plane of 150 MHz and 400 MHz, without having any mutual interference between 150 MHz signals and 400 MHz signals.

The disc antenna of the present invention consists of a plate pair made up of a conductor disc and a conductor ground plate positioned substantially in parallel with each other with a suitable distance between them. However, it is not always necessary to make them parallel with each other. They may be inclined, provided it is insured in using the antenna that no null point should be produced in the radiation electric field in the plane parallel to the conductor ground plate. Furthermore, as the conductor disc, it is possible to use a polygonal plate approximate to the prescribed disc.

Figure 9:
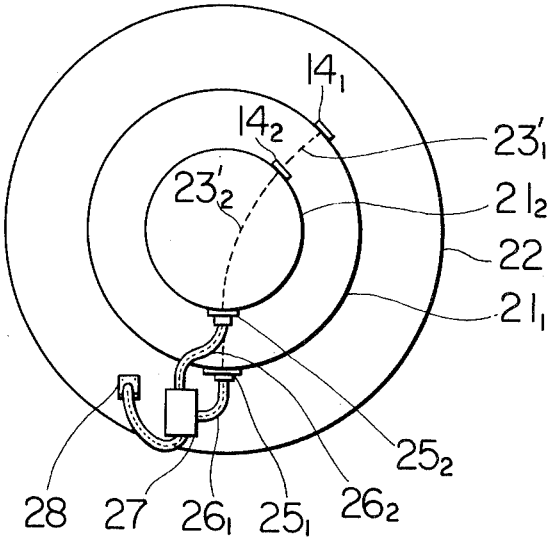
FIG. 9 is a diagram showing the construction of an antenna for joint use for 150 MHz and 400 MHz which has curved transmission lines 23' and $23_2$' for impedance matching.

With respect to the mutual relationship of the positions of the feeding point and grounding point of a disc antenna, any condition is possible, unless the two overlap and become physically impossible. In FIG. 8*a*, the grounding plates $\mathbf{25}_1$ and $\mathbf{25}_2$ and the feeding plates $\mathbf{14}_1$ and $\mathbf{14}_2$ are positioned symmetrically with respect to the center of the discs $\mathbf{21}_1$ and $\mathbf{21}_2$. Even if the grounding plates $\mathbf{25}_1$ and $\mathbf{25}_2$ and the feeding plates $\mathbf{14}_1$ and $\mathbf{14}_2$ are positioned asymmetrically with respect to the center of the conductor discs $\mathbf{21}_1$ and $\mathbf{21}_2$ as shown in FIG. 9, and the grounding plates and the feeding plates are connected with curved transmission lines $\mathbf{23'}_1$ and $\mathbf{23'}_2$ which effect impedance matching, there will be no null point produced in the radiation directivity of the disc antenna in the plane parallel to the grounding plate.

Another example of embodiment of the present invention will be described in detail.

A disc antenna of the present invention comprises a metal disc placed above a grounded metal plate (ground plate) in parallel to it at a fixed distance from it, the antenna being excited by feeding from one point on the circumference of the disc in regard to a lower frequency signal or a plurality of points on the circumference in regard to a higher frequency signal, simultaneously. Now, suppose it is an antenna for common use for two frequencies, 150 MHz and 400 MHz.

Figure 10:
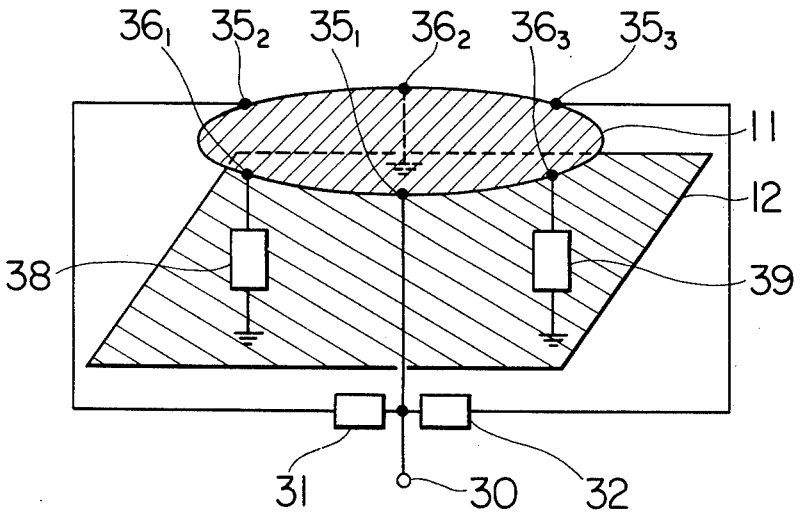
FIG. 10 is a diagram explanatory of another example of embodiment of the antenna for joint use for two frequencies according to the present invention.

FIG. 10 is a diagram explanatory of the construction of an example of an antenna for common use for two frequencies according to the present invention. In FIG. 10, the input signals coming from the input terminal 30 are immediately branched into three, one being connected to the joint feeding point $\mathbf{35}_1$ for 150 MHz, and the other two being connected to the other two feeding points $\mathbf{35}_2$ and $\mathbf{35}_3$ on the disc 11, exclusively for 400 MHz, via the filter circuits 31 and 32 which block 150 MHz and let only 400 MHz pass. The grounding point $\mathbf{36}_2$ common to 150 MHz and 400 MHz, and positioned opposite to the feeding point $\mathbf{35}_1$ is grounded directly and the other two grounding points $\mathbf{36}_1$ and $\mathbf{36}_3$, exclusively for 400 MHz are spaced apart for a predetermined distance and grounded via the reactance circuits 38 and 39.

Figure 11:
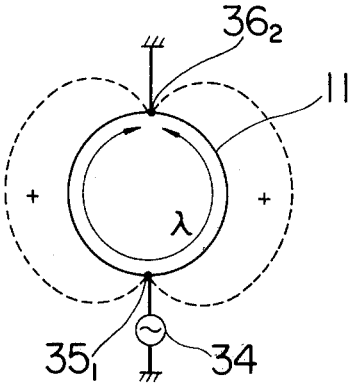
FIG. 11 is a diagram explanatory of the excitation condition at the lower frequency of the disc antenna shown in FIG. 10.

FIG. 11 is an explanatory diagram of the field distribution for the lower frequency of 150 MHz of the disc antenna of FIG. 10. In FIG. 11, the electric field distribution shown in broken lines around the disc 11 becomes all in phase, and the electric field is radiated in all directions without any null point in the planes parallel to the disc 11.

Figure 12:
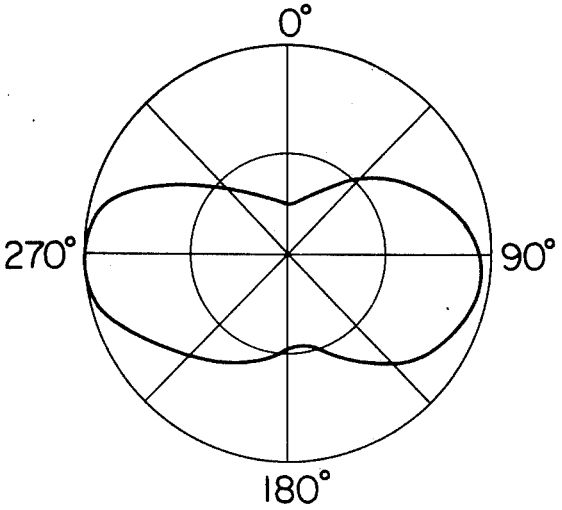
FIG. 12 is a diagram explanatory of the non-directional radiation at the lower frequency.

FIG. 12 shows the actual measurement results of radiation directivity in the horizontal plane at the 150 MHz frequency of the antenna shown in FIG. 10.

Figure 13:
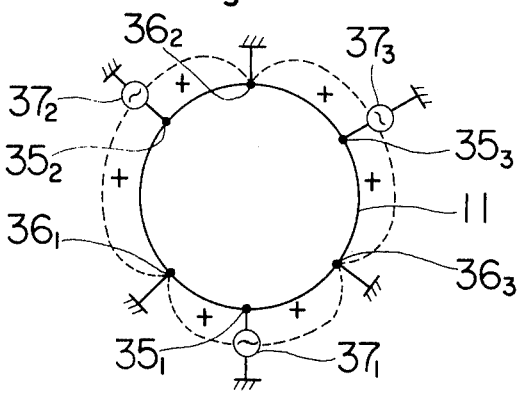
FIG. 13 is a diagram explanatory of the excitation condition at the higher frequency of the disc antenna shown in FIG. 10.

Now, this antenna is also used for operation at the 400 MHz frequency, and it is necessary to have it radiate an electric field in all directions in the horizontal plane without producing any null point. If the antenna is excited at the 400 MHz frequency by the same method as the method at 150 MHz in which the antenna is excited at one point, the electric field distribution around the disc will have antiphase (+, −) parts which will produce null points in the directivity in the horizontal plane. If all the points on the circumference of the disc are excited in phase, then the electric field distribution around the disc 11 will be made uniform, and a non-directional radiation in the horizontal plane will be obtained. However, if the number of feeding points is increased unsuitably, the radiation directivity is made to not have any null point around the antenna, but the radiation efficiency and the gain of the antenna will be reduced. In the disc antenna of the present invention, for common use for two frequencies, the circumference of the disc 11 of the antenna is divided into three sections, each of which has a length equal to, or shorter than, the wavelength $\lambda z$ of 400 MHz waves. If end points $\mathbf{36}_1$ through $\mathbf{36}_3$ of the sections are grounded and feeding is done in phase from the signal sources $\mathbf{37}_1$ through $\mathbf{37}_3$ of 400 MHz at the middle points $\mathbf{35}_1$ through $\mathbf{35}_3$ of the sections, then the electric field distribution on the circumference becomes all in phase as shown in FIG. 13, and each section operates as an independent slot antenna. In this way, it is made possible to increase the radiation efficiency of the antenna without having any null point in the directivity in horizontal plane.

Figure 14:
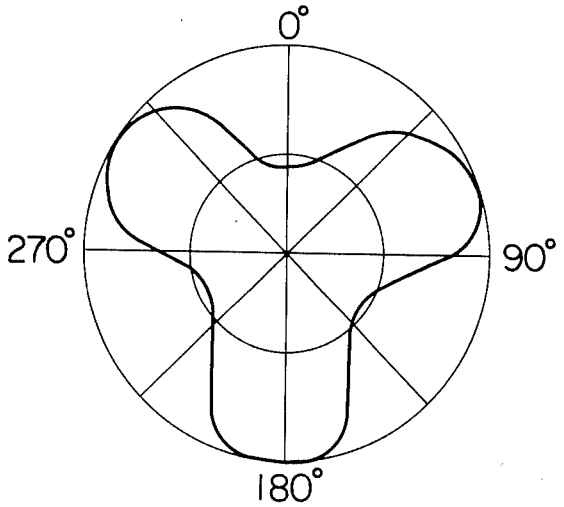
FIG. 14 is a diagram explanatory of the non-directional radiation at the higher frequency.

FIG. 14 shows the actual measurement values of horizontal plane radiation directivity where the antenna is fed in phase at 400 MHz from three points on the circumference that divide it into equal sections.

In the case of a common use antenna for two frequencies of 150 MHz and 400 MHz, the antenna was made by one-point feeding and one-point grounding for 150 MHz and three-point feeding and three-point grounding for 400 MHz. If some lowering of radiation efficiency is allowable, however, the circumference may be divided into any number of sections, provided each section has a length equal to or shorter than the wavelength of the frequency to be used.

With the disc antenna for common use for two frequencies of the present invention, it is not necessary to use a mechanical switch-over device between the one-point feeding and one-point grounding for the 150 MHz and the three-point feeding and three-point grounding for the 400 MHz. A mechanical switch-over device or switch using an active element is not only complicated, but also undesirable from the viewpoint of maintenance. In the antenna of the present invention, the change-over between the two frequencies was effected by means of the reactance circuits which are composed of only passive elements.

Figure 15:
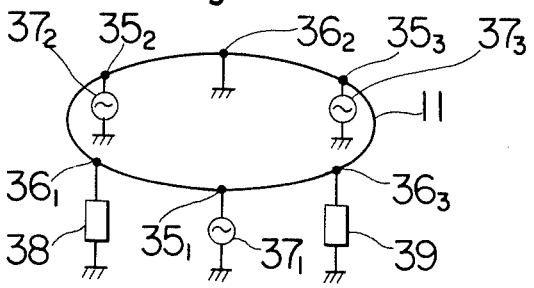
FIG. 15 is a diagram explanatory of the excitation of the higher frequency of the disc antenna shown in FIG. 10.

FIG. 15 is an equivalent circuit diagram for the excitation of the 400 MHz frequency in which the point $\mathbf{35}_1$ is commonly fed by signal sources of 150 MHz and 400 MHz and the other points $\mathbf{35}_2$ and $\mathbf{35}_3$ are fed by a 400 MHz signal source in phase through the filter circuits 31 and 32 which are inserted in series to the feeder coaxial cable so as to open the feeder at 150 MHz and close at 400 MHz, while the point $\mathbf{36}_2$ is the one common grounding point for 150 MHz and 400 MHz. The other two grounding points $\mathbf{36}_1$ and $\mathbf{36}_3$ for 400 MHz are provided with reactance circuits 38 and 39 which open at 150 MHz and close at 400 MHz. For the reactance circuits 38 and 39, coaxial cables may be used, and thus one disc of the antenna can be used commonly for two frequencies. The disc antenna for common use for two frequencies of the present invention may be operated at the same time at 150 MHz and 400 MHz, wherein the 150 MHz signal is fed from the feeding point opposite to the joint-use grounding point for 150 MHz and 400 MHz, and the 400 MHz signal is at the same time fed to the common feeding terminal for 150 MHz and 400 MHz, and to the individual feeding terminals for 400 MHz, in phase with equal amplitude.

If operated with the above-described structure, only the feeding point $\mathbf{35}_1$ and the grounding point $\mathbf{36}_2$ are engaged in the operation when the input signals are at 150 MHz. Thus, a one-point feeding one-point grounding is effected because the other feeding points $\mathbf{35}_2$ and $\mathbf{35}_3$ are blocked by the filter circuits 31 and 32 and the grounding points $\mathbf{36}_1$ and $\mathbf{36}_3$ are made open by the reactance circuits 38 and 39, respectively. When the input signals are at 400 MHz, the filter circuits 31 and 32 are passed and the reactance circuits 37 and 38 are closed, so that the feeding points $\mathbf{35}_1$ through $\mathbf{35}_3$ and the grounding points $\mathbf{36}_1$ through $\mathbf{36}_3$ all operate in phase and effect a three-point feeding and three-point grounding. Consequently, a disc antenna of a good efficiency of the same phase will be obtained for both 150 MHz and 400 MHz. There is in this connection a possibility that at the feeding points $\mathbf{35}_2$ and $\mathbf{35}_3$ exclusively for 400 MHz, signals at 150 MHz will flow back to the input terminal. Consequently, the length of the feeders connecting the filter circuits 31 and 32 with the feeding points $\mathbf{35}_2$ and $\mathbf{35}_3$ exclusively for 400 MHz must be selected to be such a length that the impedance on the feeders at the feeding points $\mathbf{35}_2$ and $\mathbf{35}_3$ becomes infinite. At the same time, it is also necessary to select the length of the feeders so as to make them in phase at the feeding points $\mathbf{35}_1$ and $\mathbf{35}_2$ in the case of 400 MHz. It is quite possible to meet this requirement.

It is ideal that the ground plate of a disc antenna be an infinite plane. In actuality, however, a disc which is somewhat larger than the conductor disc is good enough. The disc is supported by means of supporting poles of an insulating material provided between it and the ground plate. It does not matter whether the center of the disc is grounded or not, but it will make the antenna mechanically strong enough if it is supported with a metal pole.

As has been described, the present invention makes it possible to use one disc antenna both as disc antenna of one-point feeding and one-point grounding for the longer of the two input-output wavelengths, and as a disc antenna of plural-point feeding and plural-point grounding for the shorter of the two wavelengths, using the feeding point and grounding point for the longer wavelength jointly for the two wavelengths and inserting reactance circuits at the grounding points and filter circuits at the feeding points exclusive for the shorter wavelength, the selection between two input-output wavelengths being thus made automatically.

Since one disc antenna can be used jointly for two wavelengths in this manner, it is not only economical, but since it does not use any complicated switch-over mechanism or active elements, and uses reactance circuits and filter circuits consisting of passive elements only, the structure is simple, highly dependable, and easy to maintain.

Because of its shape, electric field distribution characteristic, ease of installation, etc., it is considered to be useable most effectively as an antenna to be installed in such places as underground streets and the like.

We claim:

1. A disc antenna for common use with first and second signal frequencies comprising first and second signal sources for respectively generating first and second signal frequencies, a ground plate and conductor disc spaced substantially in parallel with each other, said first and second signal sources connected to one point on the circumference of said conductor disc for signal feeding to said one point, a grounding conductor conductively shorting a circumferential point on said conductor disc diametrically opposite said one point to the point opposite said circumferential point on said ground plate, the circumference of said conductor disc divided into a plurality of sections by connection points including said circumferential point, the length of each section being at most equal to one-half of the shorter of the wave lengths of the first and second signal frequencies, said connection points dividing said sections other than said circumferential point each grounded by a first filter circuit respectively, each said first filter circuit being open to said first signal frequency and being closed to said second frequency, each middle circumferential point of each of said sections on said conductor disc connected to said one point through coaxial cables and a second filter circuit to supply the second signal frequency thereto in phase to said middle points, each said second filter being open to said first signal frequency and being closed to said second signal frequency.

2. A disc antenna comprising a conductor ground plate and a conductor disc spaced substantially in parallel with each other, a coaxial cable having a central conductor thereof for feeding signals of prescribed frequency, first means connected to said central conductor for feeding one of two possible antenna signal feeding points which are a first point of connection on the circumference of the conductor disc or a second point of connection opposite said first point on said conductor ground plate, the outer conductor of said coaxial cable connected to said conductor ground plate, and grounding means conductively shorting another point of connection on the circumference of said conductor disc which is spaced from said first feeding point on said conductor disc to an opposing point of connection on said conductor ground plate.

3. A disc antenna as claimed in claim 2, which is characterized in that said conductor disc is also used as a second conductor ground plate, a second conductor disc provided substantially in parallel with said second conductor ground plate, a second coaxial cable having a central conductor, second means connected to said second central conductor thereof for feeding signals of a second prescribed frequency connected to one of two second possible antenna signal feeding points which are a third point of connection on the circumference of the second conductor disc and a fourth point of connection opposite said third point on said second conductor ground plate, and a second grounding means conductively shorting another point of connection on said second conductor disc which is spaced from said second feeding point on said second conductor disc to an opposing point of connection on said second conductor ground plate thereby providing a disc antenna for radiating first and second non-directional waves.

4. A disc antenna as claimed in claim 3, which is characterized in that at least one more conductor disc is provided substantially in parallel to said second conductor disc and connected with additional coaxial cable in the manner claimed for said second conductor disc in order to feed different frequencies between the conductor discs respectively to radiate non-directional electric waves respectively of different frequencies.

5. A disc antenna as claimed in claim 2, which is characterized in that said outer conductor of said coaxial cable is connected to said grounding conductor means and said central conductor is extended without said outer conductor between said disc and plate substantially in parallel to said conductor ground plate and is connected to said feeding point, impedance matching between the antenna and the coaxial cable being effected at least by adjustment of the distance between said central conductor and said conductor ground plate.

* * * * *